US006634503B2

(12) United States Patent
Welsh, Jr.

(10) Patent No.: US 6,634,503 B2
(45) Date of Patent: Oct. 21, 2003

(54) PROTECTIVE DEVICE

(75) Inventor: Thomas Joseph Welsh, Jr., Aurora, IL (US)

(73) Assignee: Sierra Housewares, Inc., Chicago, IL (US)

( * ) Notice: Subject to any disclaimer, the term of this patent is extended or adjusted under 35 U.S.C. 154(b) by 17 days.

(21) Appl. No.: 09/883,687

(22) Filed: Jun. 18, 2001

(65) Prior Publication Data

US 2002/0189965 A1 Dec. 19, 2002

(51) Int. Cl.[7] ..... F41B 13/04
(52) U.S. Cl. ..... 206/553; 206/349
(58) Field of Search ..... 206/349, 387.11, 206/521, 553; 30/162

(56) References Cited

U.S. PATENT DOCUMENTS

| | | | | | |
|---|---|---|---|---|---|
| 660,302 | A | | 10/1900 | Lowman | |
| 686,838 | A | | 11/1901 | Apple | |
| 831,770 | A | * | 9/1906 | Bragg | 224/232 |
| 1,104,563 | A | | 7/1914 | Smith | |
| 1,593,935 | A | | 7/1926 | Gerick et al. | |
| 3,381,807 | A | * | 5/1968 | Vaughn | 206/363 |
| 3,512,631 | A | * | 5/1970 | Prince et al. | 206/349 |
| 4,467,524 | A | | 8/1984 | Ruff et al. | 30/2 |
| 4,825,545 | A | | 5/1989 | Chase et al. | 30/153 |
| 4,989,747 | A | | 2/1991 | Demurger | 220/324 |
| 4,998,334 | A | * | 3/1991 | Pemberton et al. | 206/359 |
| 5,002,213 | A | * | 3/1991 | Newton et al. | 224/232 |
| 5,090,564 | A | | 2/1992 | Chimienti | 206/365 |
| 5,285,575 | A | | 2/1994 | Hirano | 30/2 |
| D365,984 | S | | 1/1996 | Hofmann | D9/415 |
| 5,954,203 | A | | 9/1999 | Marconi | 206/464 |
| 6,113,617 | A | | 9/2000 | van der Merwe | 606/167 |
| 6,308,419 | B1 | * | 10/2001 | Neshat et al. | 30/151 |

OTHER PUBLICATIONS

PCT International Search Report mailed by the U.S. Patent & Trademark Office on Sep. 5, 2002.

* cited by examiner

*Primary Examiner*—David T. Fidei
(74) *Attorney, Agent, or Firm*—Gardner Carton & Douglas LLC

(57) ABSTRACT

Provided herein is a protective device for use with a variety of objects. The protective device has two sections, each section attached to the other along a first edge. The protective device has a locking mechanism whereby each section is secured to the other in a closed position. The device may also have stoppers on the inner side of each section, the stoppers aligned such that the object is secured when the device is in the closed position.

3 Claims, 3 Drawing Sheets

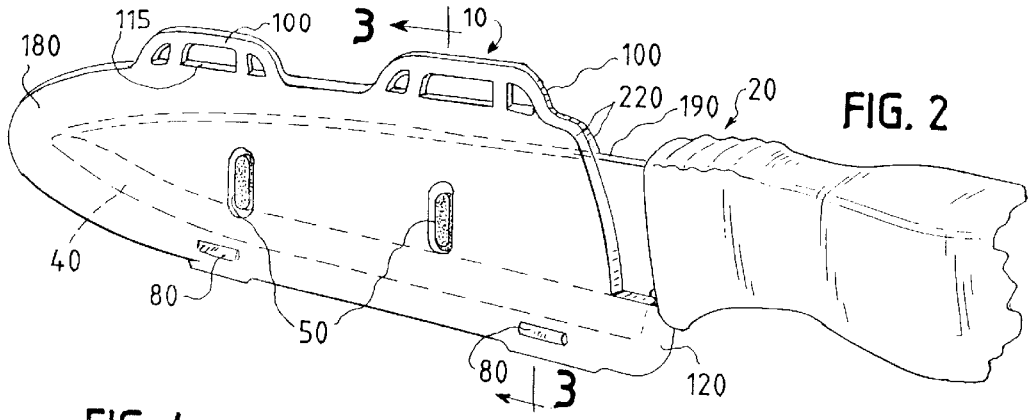
FIG. 2
FIG. 4
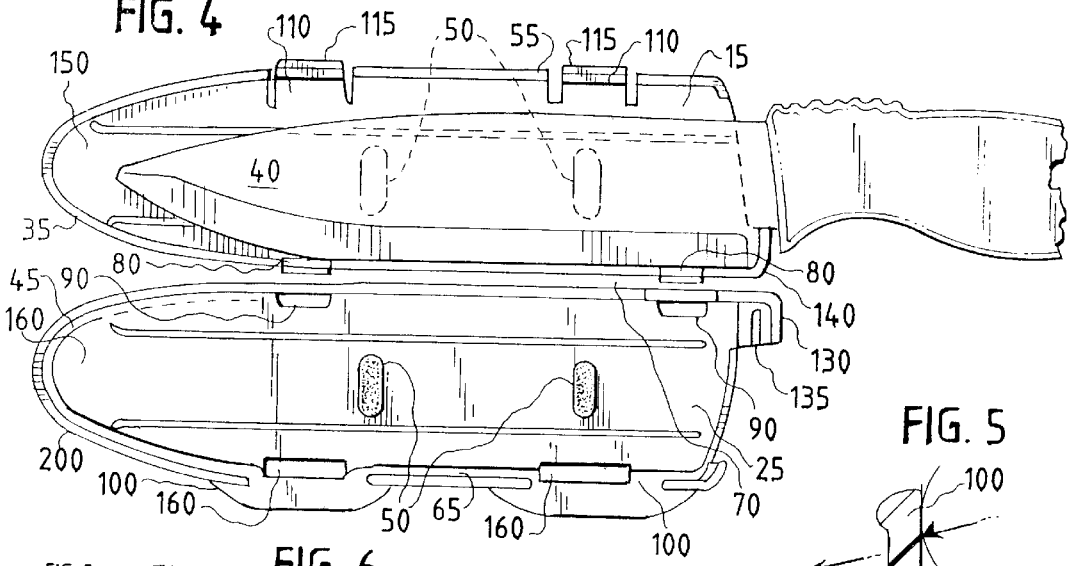
FIG. 5
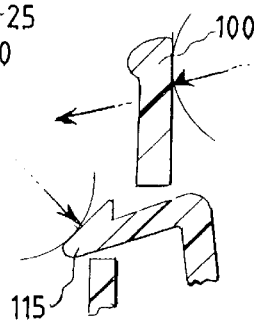
FIG. 6
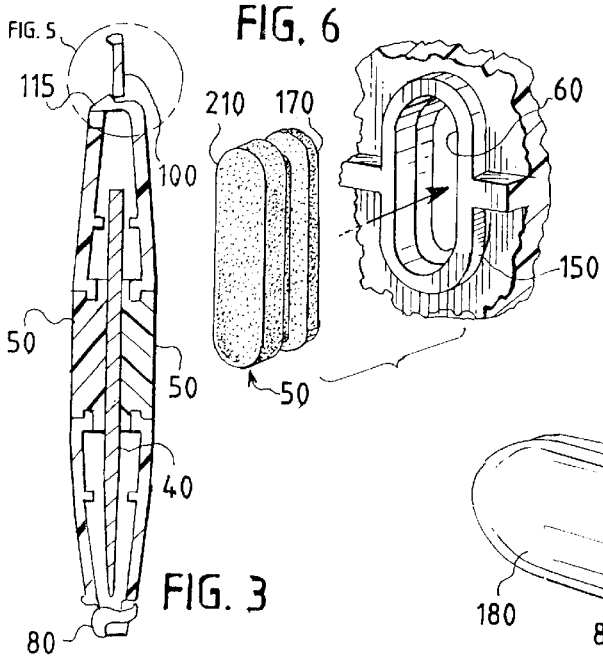
FIG. 3
FIG. 7
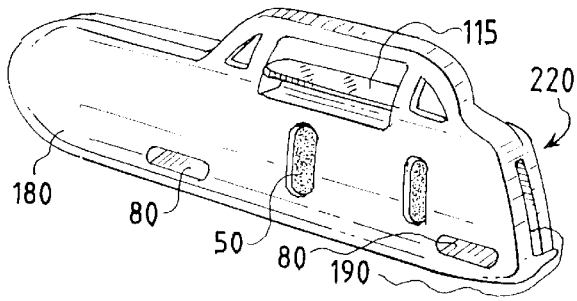

PROTECTIVE DEVICE

FIELD OF THE INVENTION

The present invention relates to a protective device for use with a variety of objects, and more specifically to a protective device that has two sections, each section secured to the other on one side and having a locking mechanism for locking the device in a closed position.

BACKGROUND OF THE INVENTION

Containers have been used as protective devices for a variety of objects. They have been used to protect objects such as swords, needles, knives and scalpels. Most of the guards used in the prior art do not provide for secure protection of a blade such that the tool can be easily transported by its handle. For instance, the prior art includes a container for storing a used hypodermic needle and an apparatus for protecting a bayonet.

One example of the prior art is a container for disposal of a used hypodermic needle. The container has two halves hingedly attached to one another. Each half has an aperture at the bottom for securing the base of the used needle and each half has a set of ribs on the interior such that, when the two halves are closed and locked, the used needle is securely held by the ribs on each half of the container. The container has a simple latch that can easily be locked and unlocked for disposing the used needle. The container is not child-resistant and can easily be opened.

Another example of the prior art is an apparatus for protecting a sword or bayonet. The apparatus has a pair of sections, each section clam-shaped and hinged to one another at the bottom of each section. The sections are clasped at the top ends of each section, therein leaving an aperture at the top such that a blade can be easily and quickly removed. The apparatus also has a spring on the interior of each section so that the blade can be kept clean of any residue. One problem with this type of prior art is that the blade is not securely contained within the apparatus. The apparatus was designed for quick removal of the sword on the battlefield, thus the blade can move and shift within the apparatus, thus potentially causing damage to the blade. Furthermore, if the apparatus is turned upside down, the blade can easily fall out of the apparatus. Like the other prior art described herein, the blade is not safely stowed and thus is not child-resistant.

A further example of the prior art provides an apparatus for storing objects. The apparatus is an elongated flat plastic box hinged along one side and having a pair of latches spaced along the opposite side. The box has a single locking device wherein the male part of the latch is connected to an actuating tab formed in the top at one end and in the bottom at the opposite end of the elongated box. The female part of the latch is formed in the opposite part of the box in mating relationship with the male part of the latch. The plastic box does not securely hold an object. The latching device can easily be opened by either an adult or child. Furthermore, the box does not provide for a handle of the object to extend out of the box such that the object can easily be carried without damage.

As the prior art examples show, a number of disadvantages remain. First, the prior art does not provide a protective device that has a child-resistant locking mechanism. Furthermore, the prior art does not provide for a protective device that securely holds an object in place such that the object does not move within the container, thus reducing potential damage to the object. Another disadvantage of the prior art is the lack of a protective device wherein an operator can transport the object by its handle while still protecting the object. Yet another disadvantage of the prior art is the lack of a protective device having a dual locking mechanism.

Therefore, what is needed is a protective device that has a child-resistant locking mechanism. What is further needed is a protective device for use with an object that securely holds the object in place such that the object is secured within the device as it is transferred from one location to another. What is further needed is a protective device for an object wherein the operator can transport the object by its handle such that the object does not fall out of the container yet is still securely protected within. What is further needed is a protective device having a dual locking mechanism.

SUMMARY OF THE INVENTION

The present invention satisfies the need for a protective device that secures an object and is child-resistant.

The present invention further satisfies the need for a protective device that securely locks the object within the device such that any sharp portions of the object do not contact the walls of the protective device when the device is in a closed position.

The present invention further satisfies the need for a protective device that immobilizes the object such that the object cannot fall out of the device when the device is held in various positions, yet may provide a cavity such that a handle of the object extends from the protective device whereby the handle can be carried for easy and safe transportation of the object from one location to another.

The present invention provides a protective device for use with a variety of objects. The protective device has two sections, each section rotatably attached to the other along a first edge. The device also provides a locking mechanism, the locking mechanism securing the two sections to the other along the second edge of each section such that the protective device is locked in a closed position.

The present invention may also provide stoppers located on an inner side of each section, the stoppers aligned with one another on the inner side of each section such that the object is secured between the stoppers when the device is in the closed and locked position. Furthermore, there may be provided a bottom portion, such that the bottom portion, when the device is in the closed position, forms a cavity such that a handle of the object extends outside the device for ease of transporting the object when the device is in the closed position. The bottom portion also has a flange, the flange providing a positive stop such that the object is secured within the protective device.

The above advantages, features and aspects of the present invention are readily apparent from the following detailed description, appended claims and accompanying drawings.

BRIEF DESCRIPTION OF THE DRAWINGS

FIG. 2 is a perspective view of a protective device made in accordance with the principles of the present invention;

FIG. 3 is a cross sectional view along the lines 3–3' of FIG. 2 of the protective device made in accordance with the principles of the present invention;

FIG. 4 is a top view of the protective device made in accordance with the principles of the present invention illustrating an open position;

FIG. 5 is a magnified cross section of the protective device made in accordance with the principles of the present invention;

FIG. 6 is an exploded perspective view of a stopper of the protective device made in accordance with the principles of the present invention;

FIG. 7 is a perspective view of the protective device made in accordance with the principles of the present invention illustrating a single locking mechanism.

DETAILED DESCRIPTION OF THE INVENTION

Figure 1:
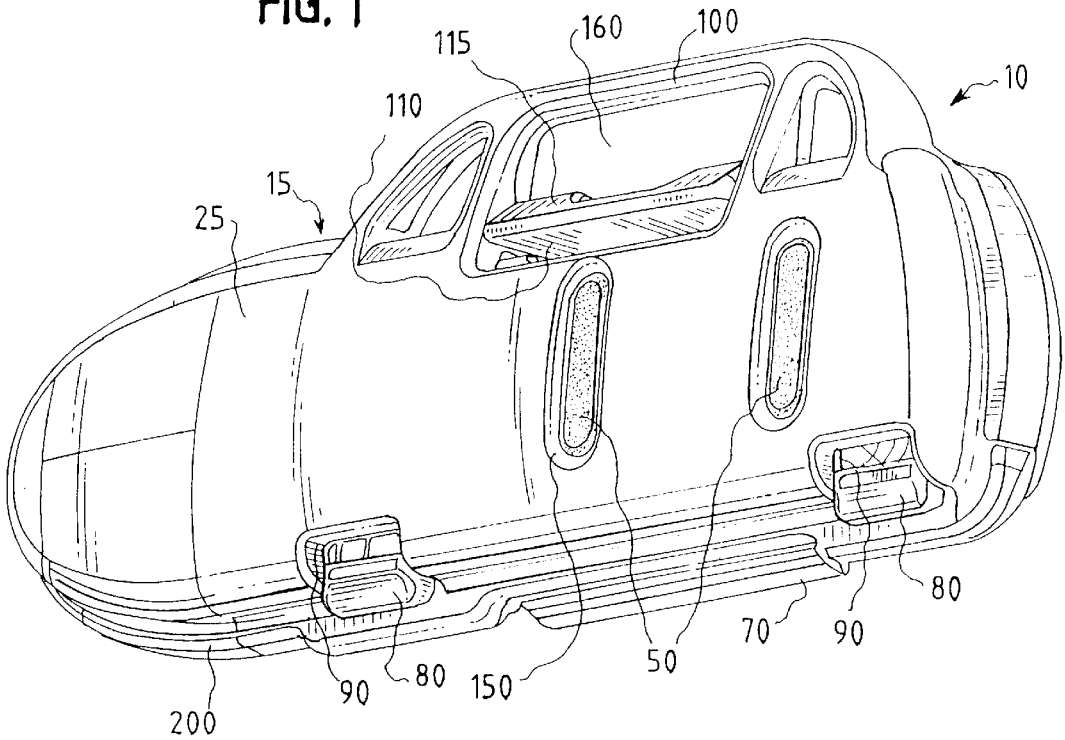
FIG. 1 is a perspective view of a protective device made in accordance with the principles of the present invention.

Described herein is a protective device for securing an object for transport. The device may be used with a variety of objects and is not limited to the examples cited herein.

As illustrated in FIGS. 1–6, there is illustrated, in accordance with a first embodiment of the present invention, a protective device 10 for securing an object (not shown) for transport. The protective device 10 has a first section 15 and a second section 25, the first and second section 15, 25 each having a first edge 35, 45 and a second edge 55, 65 as shown in FIG. 4. The first edge 35 of the first section 15 is rotatably secured to the first edge 45 of the second section 25 with a living hinge 70. The first edge 35 of the first section 15 also has at least one clasp 80. The clasp 80 rotates with respect to the living hinge 70 and engages at least one aperture 90 along the first edge 45 of the second section 25, the clasp 80 adapted to secure the first section 15 to the second section 25, or alternatively, may be a locking mechanism for securing the first section 15 to the second section 25. The clasp 80 provides an additional barrier such that the living hinge 70 is protected from any movement of the object within the device during transport.

The protective device 10 also has a primary locking mechanism for locking the first section 15 to the second section 25. The second edge 55 of the first section 15 has at least one male member 110 for engaging at least one female member 100 along the second edge 65 of the second section 25. The male member 110 has a lip 115 such that as the male member 110 passes through an aperture 160 of the female member 100, the lip 115 engages the female member 100 thereby securing the protective device 10 in a closed position.

In this embodiment of the present invention as shown in FIGS. 1 and 6, there is also provided a plurality of stoppers 50 for securing the object. The first section 15 and second section 25 each have at least one stopper 50 positioned on an inner side 150, 160 of each section 15, 25. Each section 15, 25 has a hole 60, the stopper 50 positioned inside the hole 60 and having a lip 170 on one end to engage an outer side 180 of each section 15, 25 and an elongated flat surface 210 on the opposite end positioned on the inner side 150, 160 of each section 15, 25 for engaging the object. Furthermore, the stoppers 50 are preferably aligned with one another along the elongated flat surface 210 on the inner side 150, 160 of each section 15, 25 thereby forming a pair of stoppers that compress and conform to objects having a variety of thickness and contours and is adapted to secure the object between the pair of stoppers 50. Thus, as the first section 15 and second section 25 are rotated towards one another and subsequently closed in a locked position as shown in FIG. 1, the alignment of the stoppers 50 from the first and second sections 15, 25 combine to exert a clamping force on the object thereby securing the object within the protective device 10. The stoppers 50 are compliant friction pads, made of a resilient rubber, or any other material as will be appreciated by one skilled in the art, such that the resilient rubber provides enough frictional resistance between each pair of stoppers 50 to secure the object within the device 10 when the device 10 is in the locked position.

In this embodiment of the present invention, the second section 25 has a lip 200 extending substantially around the perimeter of the second section 25. The lip 200 overlaps the outer edge of the first section thereby providing additional protection for the object and a user. Furthermore, the lip 200 prevents access to the inner portion of the protective device 10 even in the event of warpage caused to the protective device 10 during the molding process of the device 10 or the stresses incurred while locking the device. As will be appreciated by one skilled in the art, the combination of the living hinge 70, the locking mechanism and the lip 200 provides for a protective device 10 that is also child resistant as they combine to enclose and lock the object within the protective device 10.

Turning next to FIGS. 2–4, there is illustrated, in accordance with a second embodiment of the present invention, a protective device 10 for use with a tool 20 wherein the tool 20 may have a blade 40. The protective device 10 has a first section 15 and a second section 25, the first and second section 15, 25 each having a first edge 35, 45 and a second edge 55, 65. The first edge 35 of the first section 15 is rotatably secured to the first edge 45 of the second section 25 with a living hinge 70. The first edge 35 of the first section 15 also has at least one clasp 80. The clasp 80 rotates with respect to the living hinge 70 and engages at least one aperture 90 along the first edge 45 of the second section 25, the clasp 80 providing additional means for securing the first section 15 to the second section 25, or alternatively, may be a locking mechanism for securing the first section 15 to the second section 25. The at least one clasp 80 provides an additional barrier such that the living hinge 70 is protected from the blade 40 and is therefore not cut or damaged by the blade 40.

The protective device 10 also has a primary locking mechanism for locking the first section 15 to the second section 25. The second edge 55 of the first section 15 has at least one male member 110 for engaging at least one female member 100 along the second edge 65 of the second section 25. The male member 110 has a lip 115 such that as the male member 110 passes through an aperture 160 of the female member 100, the lip 115 engages the female member 100 thereby securing the protective device 10 in a closed position.

In this embodiment of the present invention as shown in FIGS. 3 and 6, there is also provided a plurality of stoppers 50 for securing the blade 40. The first section 15 and second section 25 each have at least one stopper 50 positioned on an inner side 150, 160 of each section 15, 25. Each section 15, 25 has a hole 60, the stopper 50 positioned inside the hole 60 and having a lip 170 on one end to engage an outer side 180 of each section 15, 25 and an elongated flat surface 210 on the opposite end positioned on the inner side 150, 160 of each section 15, 25 for engaging the blade 40. Furthermore, the stoppers 50 are preferably aligned with one another along the elongated flat surface 210 on the inner side 150, 160 of each section 15, 25 thereby forming a pair of stoppers that compress and conform to various blade 40 thickness and contours such that the blade 40 is secured between the pair of stoppers 50. Thus, as the first section 15 and second section 25 are rotated towards one another and subsequently closed in a locked position, the alignment of the stoppers 50 from the first and second sections 15, 25 combine to exert a clamping force on the blade 40 thereby securing the blade 40 into position within the protective device 10. The stoppers 50 are compliant friction pads, made of a resilient rubber, or any other material as will be appreciated by one skilled in the art, such that the resilient rubber provides enough frictional resistance between each pair of stoppers 50 to secure the blade 40 or any other object within the device when the device 10 is in the locked position.

When the protective device 10 is in the locked position as shown in FIG. 2, the first section 15 and second section 25 combine to form a bottom portion 220, the bottom portion 220 having a cavity 190 therethrough. The cavity 190 provides for a handle 30 extending from the blade 40 for easy carrying of the tool 20 while the blade 40 is still protected. The bottom portion 220 also has a lip 120 extending from both the first section 15 and the second section 25 to provide additional means for securing the blade 40 when the protective device 10 is in a closed and locked position. Alternatively, the tool 20 may have a blade 40 that extends beyond the cavity 190 of the bottom portion 220. In this embodiment of the present invention, the lip 120 provides additional protection of the blade 40 protruding from the protective device 10. As illustrated in FIGS. 2 and 4, the first section 15 has a first flange 140 extending from the first edge 35 and is received by a second flange 130 extending from the first edge 45 of the second section 25. The second flange 130 has an interior wall 135 such that the first flange 140 engages the space between the second flange 130 and the interior wall 135 thereby forming the lip 120. The interior wall 135 protects the seam between the first flange 140 and the second flange 130 when the device is in the locked position. In the locked position, the first flange 140 is engaged in the second flange 130 such that the lip 120 formed acts as a positive stop and thereby secures the blade 40 within the protective device 10. In this embodiment of the present invention, the lip 120 may be used instead of, or as an addition to, the stoppers 50 for securing the tool 40 within the protective device 10.

As additional protection for the blade 40, the second section 25 has a lip 200 extending substantially around the perimeter of the second section 25. The lip 200 overlaps the first edge 35 and second edge 55 of the first section 15 of the protective device 10 in the closed position thereby providing additional means of protection both for the blade 40 and for the operator of the tool 20. This further prevents access to the inner portion of the protective device 10 even in the event of warpage caused to the protective device 10 during the molding process of the device 10 or the stresses incurred while locking the device. As will be appreciated by one skilled in the art, the combination of the living hinge 70, the locking mechanism and the lip 200 provides a protective device 10 that is also child resistant as these features cover the sharp edges of the blade 40.

In an alternate embodiment of the present invention as shown in FIG. 7, the protective device 10 may only have a single locking mechanism along the second edge 55, 65 of the first and second sections 15, 25 for locking the protective device 10 in a closed position. This single locking mechanism provides for a protective device 10 that is smaller and more compact to accommodate smaller tools 20 having smaller blades 40. The protective device 10 may or may not have an additional flange 130, 140 along the first edge 35, 45 of each section 15, 25 as additional securing means depending on the size of the handle 30 as will be appreciated by one skilled in the art.

Figure 8:
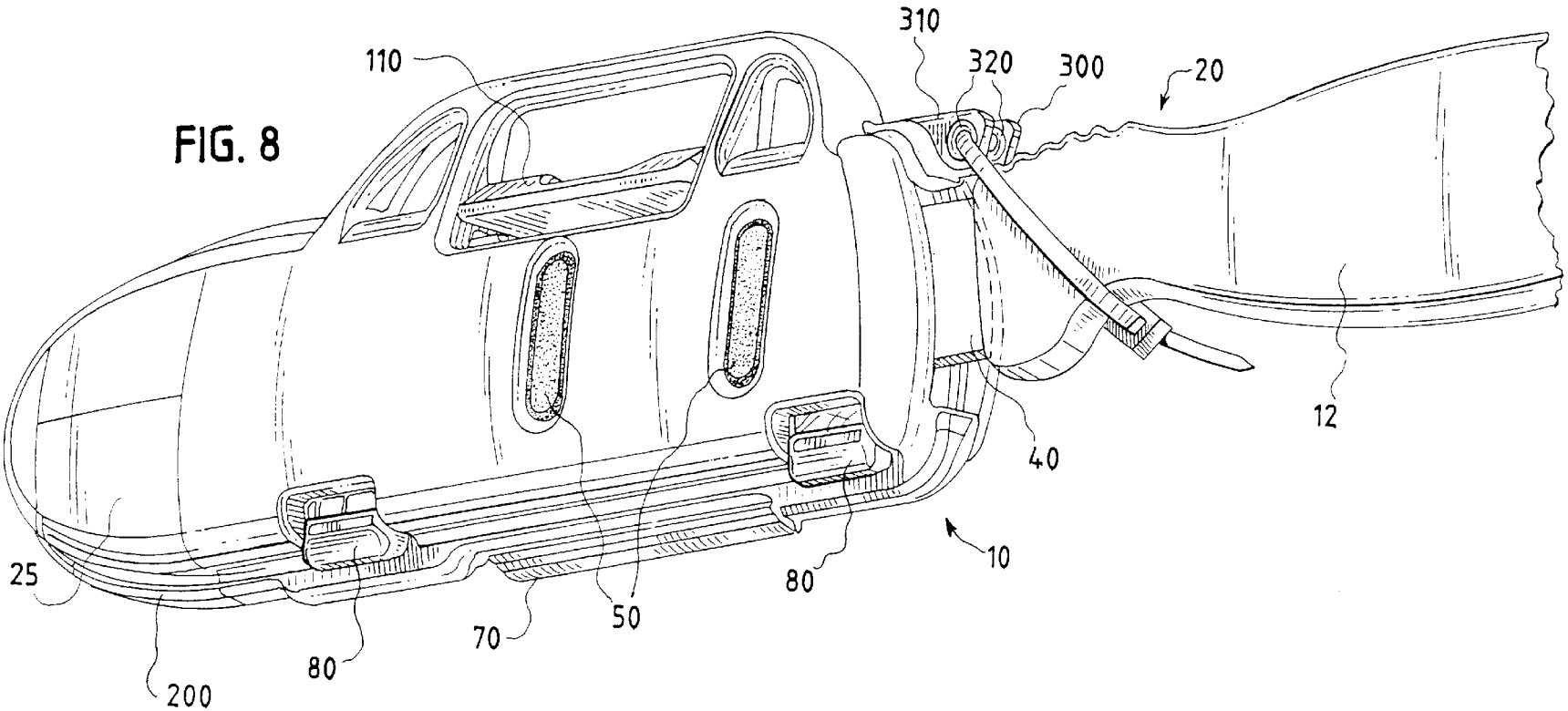
FIG. 8 is a perspective view of the protective device made in accordance with the principles of the present invention for use with a tool having a blade.

The protective device 10 may also include, as shown in FIG. 8, an additional locking mechanism for securing a handle 12 of the tool 20 to the protective device 10. The first section 15 and the second section 25 each have an extension 300, 310. The extension 300, 310 have an aperture 320, the aperture 320 aligned with each other when the device is in the locked position. Each extension 300, 310 may receive a locking tie or plastic ring, the tie threadable through each aperture 320 thereby securing the handle 12 of the tool 20 to the protective device 10.

The preferred embodiment of the present invention may be made of a durable plastic in a single mold. Furthermore, the protective device 10 may be transparent such that the operator of the tool 70 can clearly see the object through the protective device 10.

While only a few embodiments of the protective device for use with a tool having a blade of the present invention have been described and illustrated in detail herein, it will be evident to one of ordinary skill in the art that other embodiments may be possible without departing from the scope of the following claims.

What is claimed is:

1. A protective device comprising:

a first section and a second section, the first and second section haying a first and second edge, the first and second section rotatably secured to each other on the first edge;

a locking mechanism securing the first section to the second section in a closed position; and a plurality of stoppers positioned on an inner side of each section, the stoppers on the inner side of the first section opposed to the stoppers on the inner side of the second section and adapted to secure an object between the stoppers such that the object is secured within the device wherein the first and second sections have a plurality of holes, the holes securing the stoppers such that the stoppers protrude from the inner side of the first and second sections to secure the object.

2. A protective device comprising:

a first section and a second section, the first and second section having a first locking mechanism on a first edge of each section;

a second locking mechanism securing the first section to the second section on a second edge of each section such that the first and second section can be locked in a closed position; and a plurality of stoppers positioned on an inner side of each section, the stoppers on the inner side of the first section opposed to the stoppers on the inner side of the second section and adapted to secure an object between the stoppers such that the object is secured within the device wherein the first and second sections have a plurality of holes, the holes securing the stoppers such that the stoppers protrude from the inner side of the first and second sections to secure the object.

3. A protective device comprising:

a first section and a second section, the first and second section having a first and second edge, the first section having at least one clasp on the first edge, the at least one clasp engaging at least one aperture on the first edge of the second section;

a locking mechanism securing the first section to the second section in a closed position; and a plurality of stoppers positioned on an inner side of each section, the stoppers on the inner side of the first section opposed to the stoppers on the inner side of the second section and adapted to secure an object between the stoppers such that the object is secured within the device wherin the first and second sections have a plurality of holes, the holes securing the stoppers such that the stoppers protrude from the inner side of the first and second sections to secure the object.

* * * * *